US006619950B2

(12) United States Patent
Ricci

(10) Patent No.: US 6,619,950 B2
(45) Date of Patent: Sep. 16, 2003

(54) CANDLE MAINTENANCE DEVICE AND METHOD

(76) Inventor: John B. Ricci, 7910 Locke La., Suite 24, Houston, TX (US) 77063

( * ) Notice: Subject to any disclaimer, the term of this patent is extended or adjusted under 35 U.S.C. 154(b) by 0 days.

(21) Appl. No.: 09/854,011

(22) Filed: May 11, 2001

(65) Prior Publication Data

US 2002/0031738 A1 Mar. 14, 2002

Related U.S. Application Data

(60) Provisional application No. 60/203,704, filed on May 11, 2000.

(51) Int. Cl.[7] ..... F23D 3/28; F23Q 7/12

(52) U.S. Cl. ..... 431/253; 431/120; 431/255; 431/344

(58) Field of Search ..... 431/127.12, 153, 431/144, 145, 255, 256, 258, 344; 30/125, 131; 126/401, 405, 414, 415

(56) References Cited

U.S. PATENT DOCUMENTS 3,200,822 A 8/1965 Meyer
4,897,033 A 1/1990 Yang
5,865,614 A 2/1999 Hsu
5,911,573 A * 6/1999 Tsai ..... 431/253
5,913,676 A 6/1999 Kim
5,975,888 A 11/1999 Hsu

* cited by examiner

*Primary Examiner*—James C. Yeung
(74) *Attorney, Agent, or Firm*—Kenneth A. Roddy

(57) ABSTRACT

A candle maintenance device according to the invention preferably has a body with a handle portion to grip the device. A trigger is used to engage a wick cutting element and lighting element. The wick cutting element preferably includes a cutting actuator mechanism, cutting guide and cutting device. The lighting element preferably includes a fuel cell for housing a fuel, fuel lines and an igniter source. A candlewick placed in the wick cutting element will be drawn into or forced against a cutting device such as a cutting blade. Contemporaneously with the cutting of the wick, the lighting element will release fuel from the fuel cell and ignite the fuel via the igniter source. The fuel is discharged through piping to a location in close proximity to the cutting device. An igniter source causes a spark to ignite the fuel thereby igniting the wick.

21 Claims, 6 Drawing Sheets

CANDLE MAINTENANCE DEVICE AND METHOD

This application claims the benefit of the filing date of Provisional Application Ser. No. 60/203,704 filed May, 11, 2000, now pending (hereby incorporated by reference for all purposes).

BACKGROUND OF THE INVENTION

The invention relates to devices used to ignite candles, cut or trim candlewicks and, more particularly, a combination of a lighting device and a candlewick cutting device.

Lighting devices commonly in use today are limited to their ability of ignition only. Therefore, the problem of trimming the candlewick still exists. There are devices capable of trimming the candlewick, however this process involves having two utensils. One to trim the candlewick, and another to light the trimmed candlewick.

In view of the aforementioned problems, the need exists for a device that is capable of both trimming the candlewick and lighting the candle.

BRIEF SUMMARY OF THE INVENTION

The present invention provides a candle maintenance device combining a cutting device and lighting device to satisfy the aforementioned needs. The present invention relates generally to a method and apparatus of candle maintenance.

A candle maintenance device according to the invention preferably has a body with a handle portion to grip the device. A trigger is used to engage a wick cutting element and lighting element. The wick cutting element preferably includes a cutting actuator mechanism, cutting guide and cutting device. The lighting element preferably includes a fuel cell for housing a fuel, fuel lines and an igniter source. A candlewick placed in the wick cutting element will be drawn into or forced against a cutting device such as a cutting blade. Contemporaneously with the cutting of the wick, the lighting element will release fuel from the fuel cell and ignite the fuel via the igniter source. The fuel is discharged through piping to a location in close proximity to the cutting device. An igniter source causes a spark to ignite the fuel thereby igniting the wick.

In one feature of the present invention, the inventive device includes an extinguishing and extractor tool, also referred to as a wick tool. This wick tool provides the user of the candle maintenance device, a tool to extinguish a burning candlewick or manipulate the candle wax to extract the candlewick.

In another feature of the present invention, the device includes a safety lock to prevent the inadvertent triggering of the device. The safety lock must be released before the trigger of the invention will function.

These and other features and advantages of the present invention will become apparent to those skilled in the art from the following detailed description of one more preferred embodiments and the accompanying drawings.

BRIEF DESCRIPTION OF THE DRAWINGS

To facilitate the understanding of the characteristics of this invention, the following drawing figures have been provided, wherein.

DETAILED DESCRIPTION OF THE INVENTION

Figure 1:
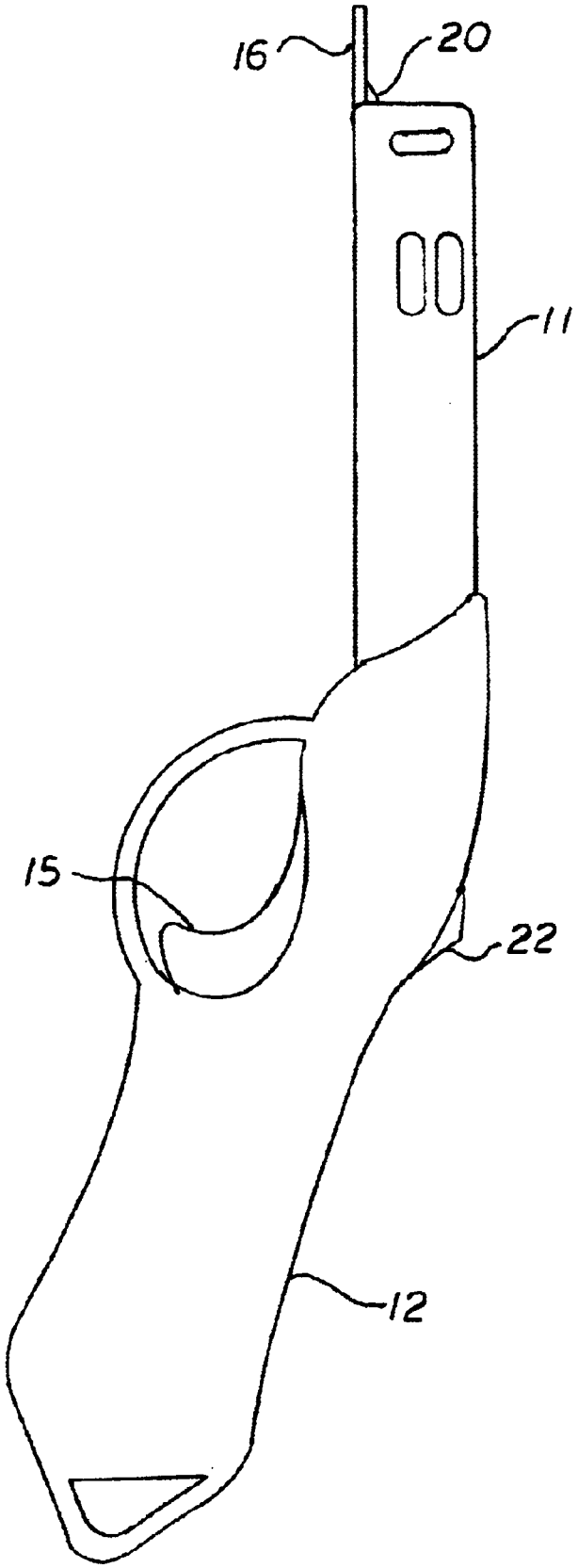
FIG. 1 is a side view of a candle maintenance device according to the invention.
Figure 2:
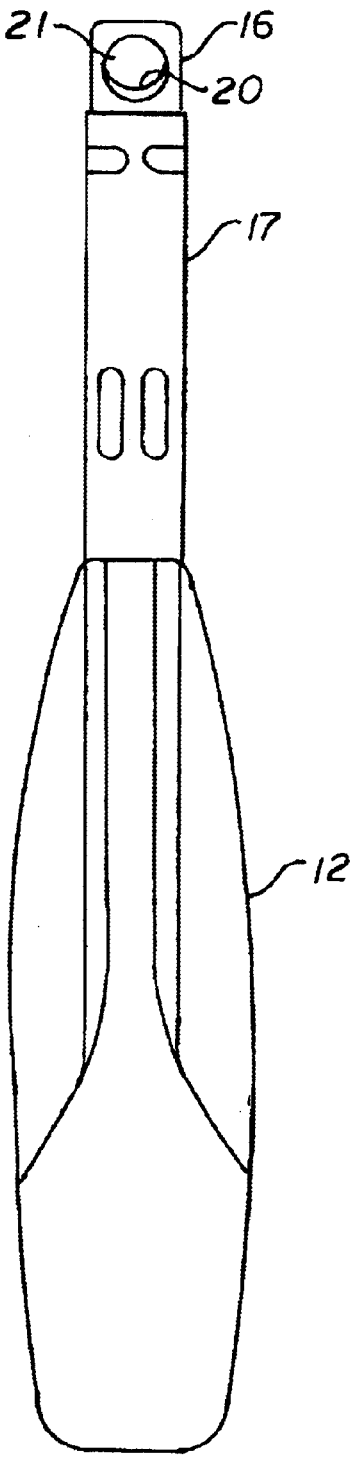
FIG. 2 is a bottom view of the device of FIG. 1.
Figure 3:
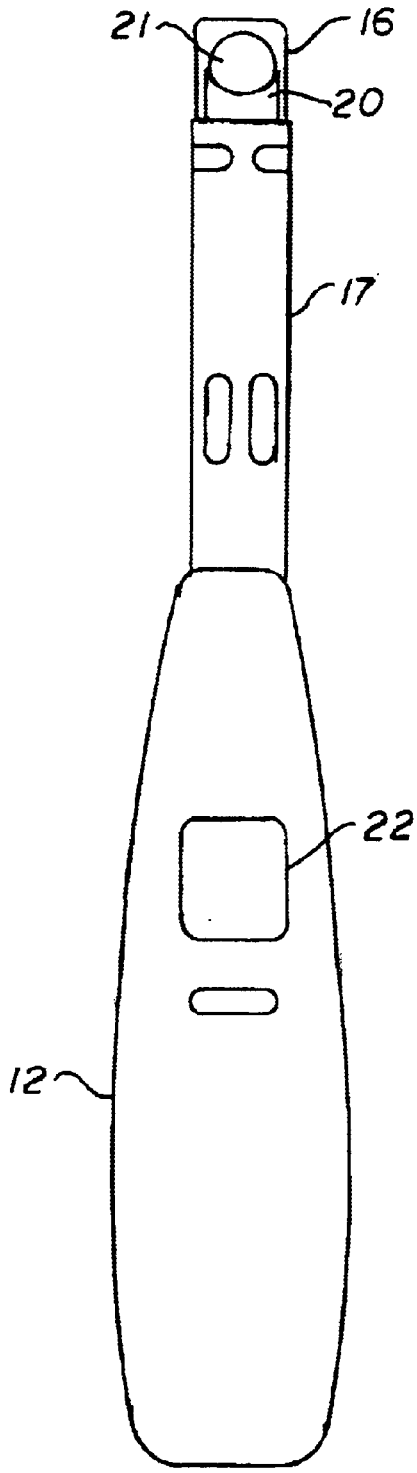
FIG. 3 is a top view of the device of FIG. 1.
Figure 4:
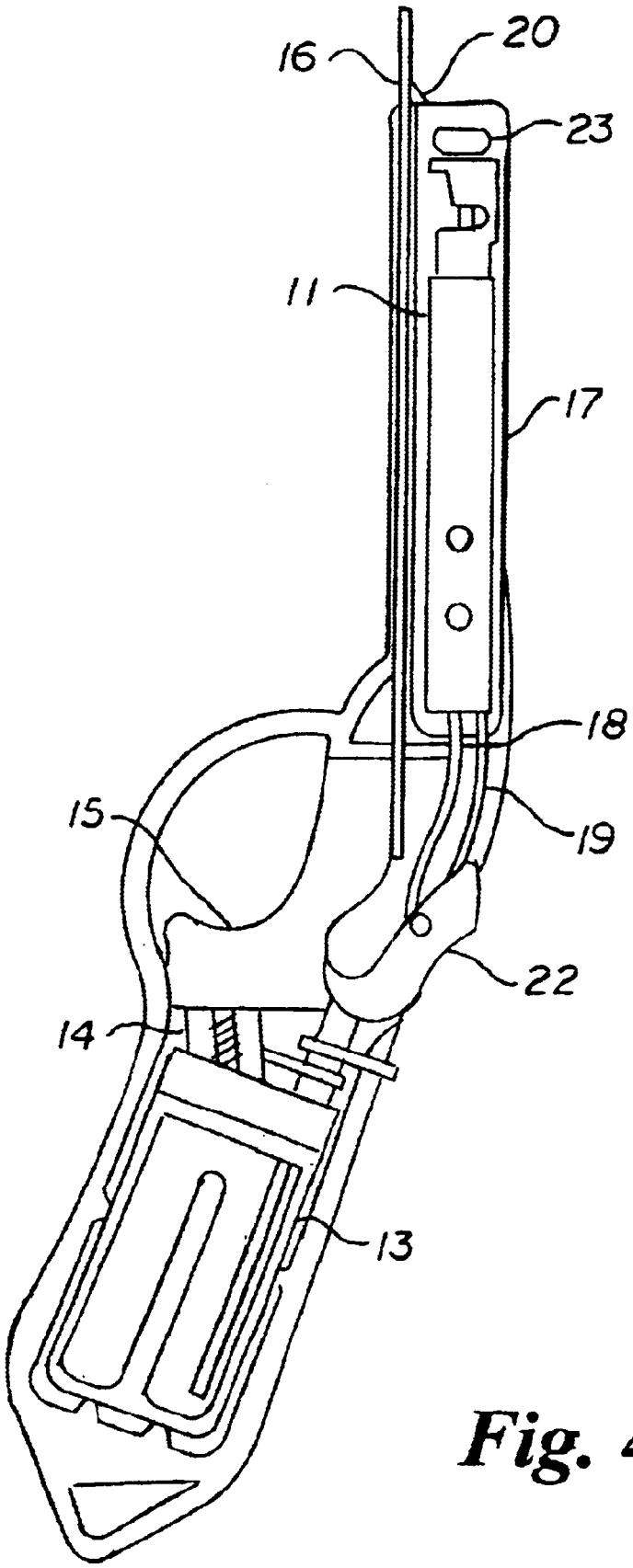
FIG. 4 is a side view similar to FIG. 1 but eliminating certain portions to more clearly show the actuating assembly.
Figure 5:
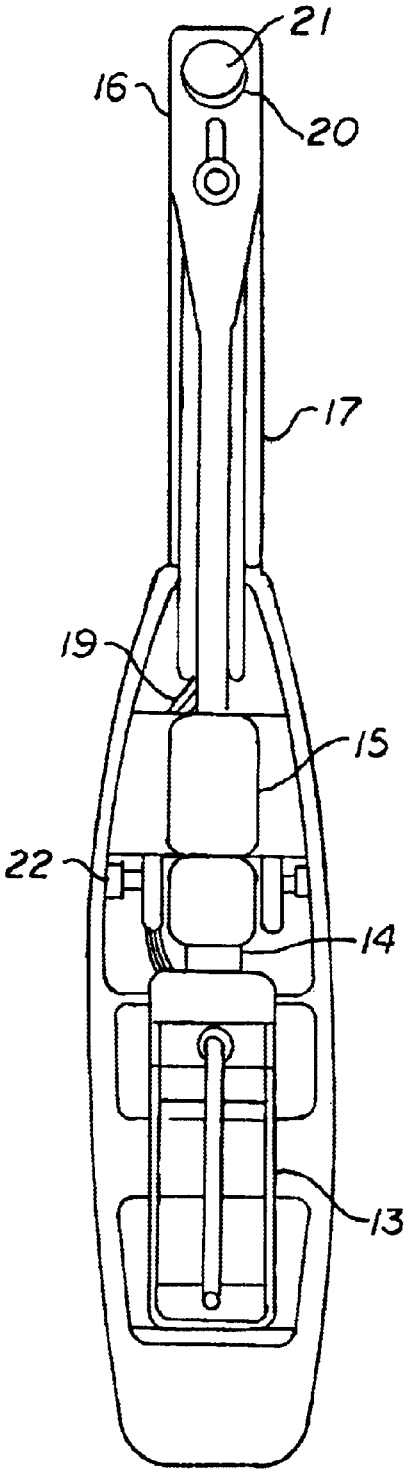
FIG. 5 is a bottom view similar to FIG. 2 but eliminating certain portions to more clearly show the actuating assembly.
Figure 6:
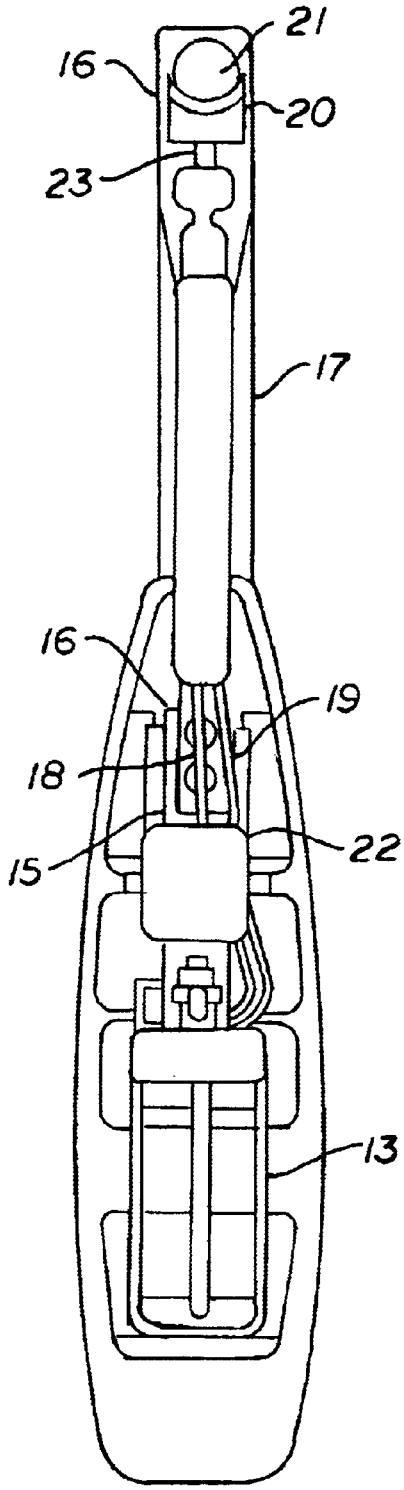
FIG. 6 is a top view similar to FIG. 3 but eliminating certain portions to more clearly show the actuating assembly.

The present invention is a combination igniter and cutting device within one device or tool having the capability to perform multiple functions particularly adapted for candle maintenance. The combination tool can be used to cut, or trim the wick of a candle and ignite the trimmed candlewick.

FIGS. 1–6 depict one combination tool according to the invention. The candle maintenance device has a body with a handle portion to grip the device. A trigger is used to engage a wick cutting element and lighting element. The wick cutting element preferably includes a cutting actuator mechanism 16, cutting guide 21 and cutting device 20. The lighting element preferably includes a fuel cell 13 for housing a fuel, fuel lines 18 and an igniter source 15.

The combination tool has a hollow handle portion 12 and an elongated tube portion 11. Together the handle portion 12 and tube portion 11 make up the body of the device. The handle portion 12 is preferably formed of molded plastic parts that can be joined and secured by adhesive, a snap junction, and or anchoring devices such as rivets, screws, etc.

The handle portion 12 is hollow and contains a fuel cell 13 which houses a fuel source, such as commonly used combustible gases (e.g., butane, propane or other gases), igniter source 14, trigger 15, and cutting actuator mechanism 16. In an alternate embodiment, the trigger 15 may also be a lever that engages the cutting actuator. The hollow interior of the handle includes placement slots to prevent and guide the movement of the internal parts. The elongated tube portion 11 is constructed preferably of metal used as fire shield 17 and houses the fuel line 18, ignition charge wires 19, cutting device 20 (such as a blade) and the cutting actuator mechanism 16. The fire shield 17 provides protection to the fuel line 18 and adds strength and rigidity to the device. The elongated tube portion 11 is attached to the handle portion 12 by adhesive, a snap junction, and or anchoring devices such as rivets, screws, etc.

In one embodiment the fuel cell is a replaceable cartridge that may be placed into the body of the candle maintenance device. Alternatively, the fuel cell may be a fixed (i.e., non-removable) fuel cell that may either be refillable or non-refillable.

The trigger 15 is protected from accidental engagement by a safety lock 22. When the safety lock is released, preferably by depressing the safety lock into the body, the trigger may then be engaged. When the trigger 15 is engaged, three functions occur simultaneously. First the cutting actuator mechanism 16 is retracted into the elongated tube portion 11. Retraction of the cutting actuator mechanism 16 will facilitate the cutting of a candlewick by forcing the candlewick against the cutting device 20, when a candlewick is inserted into the cutting guide 21. Second, the fuel cell 13 is activated to release fuel through the fuel line 18 to the tip of the igniter 23. And third, the igniter source 15 is activated to send a charge to the tip of the igniter 23, igniting the released fuel.

Figure 7:
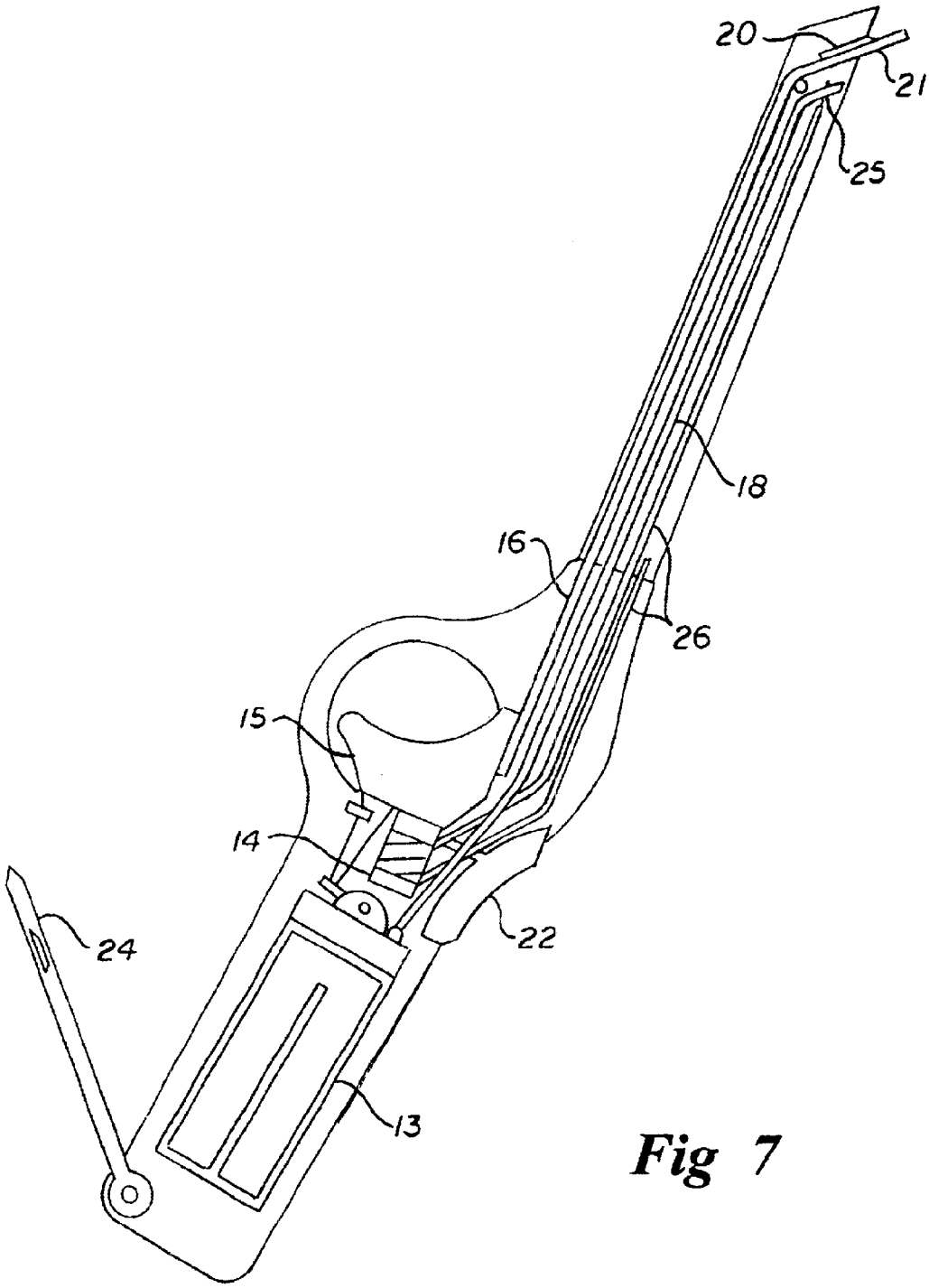
FIG. 7 is a side view of an alternate embodiment of the invention.
Figure 8:
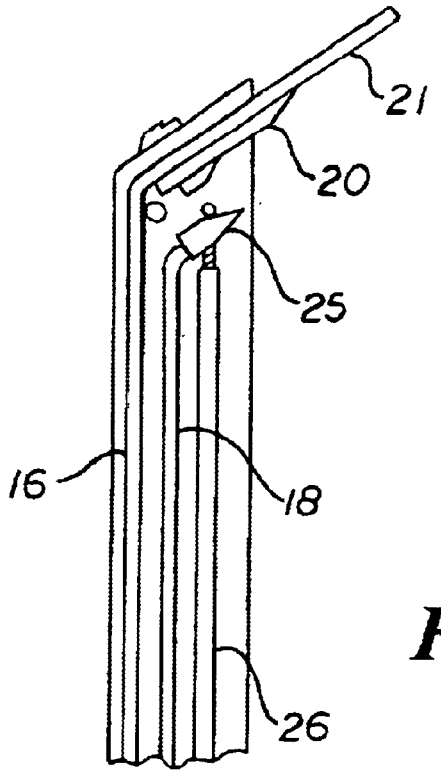
FIG. 8 is a side view of an interior of a tube portion of the invention illustrated in FIG. 7.
Figure 9:
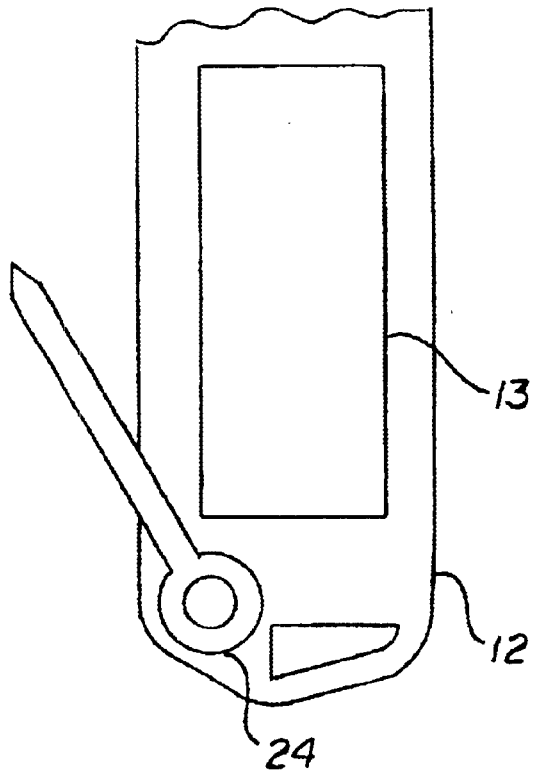
FIG. 9 is a side view of a handle portion of the invention illustrated in FIG. 7.

Now referring to FIGS. 7–9, an alternative embodiment of the inventive device is shown. This device as shown performs the function of cutting a candlewick by insertion of the wick into the cutting guide 21 and activating the trigger 15. Movement of the trigger 15 is prohibited by the safety lock 22, which must be activated during this process. The motion of the trigger 15 is transferred to the cutting guide 21 by the cutting actuator mechanism 16 which retracts the cutting guide 21. A wick inserted into the cutting guide 21, will thus be forced against the cutting blade 20. The function of lighting occurs contemporaneously during the activation of the trigger 15. The trigger 15 activates the valve on the fuel cell 13 releasing gas through the fuel line 18 to the nozzle located at the tip of the lighter. The piezoelectric source 14 is also activated by the trigger source 15. The piezoelectric source 14 via wiring 26 releases an electric current which creates a spark at the tip of the fuel nozzle 25 to ignite the gas.

The inventive device may also include a retractable extinguisher and extractor tool, referred to as a wick tool 24. Preferably the tool is hingedly attached and contained within the handle portion of the inventive device. The tool may, however, be placed elsewhere on the inventive device, for example on the tube portion of the device. The tool also may be connected or housed within the inventive device by other means. In its open position, the extinguishing and extracting tool allows manipulation of a burning candlewick into the candle wax to extinguish the flame. This tool can also be used as a digging device to remove wax around the wick if it becomes embedded or too short.

Alternatives of the inventive device include location and type of cutting action, function independent of igniting, and/or possible exclusion of the extinguishing/extractor tools. Moreover, the embodiments described are further intended to explain the best modes for practicing the invention, and to enable other skilled in the art to utilize the invention in such, or other, embodiments and with various modifications required by the particular applications or uses of the present invention. It is intended that the appending claims be construed to include alternative embodiments to the extent that it is permitted by the prior art.

What is claimed is:

1. A candle maintenance device comprising:

a body having a handle portion;

wick cutting means movably supported on said body for cutting a candlewick upon reciprocal movement relative to said body;

wick lighting means supported on said body for igniting the candlewick upon activation thereof; and trigger means on said body operatively interconnected with said wick cutting means to reciprocate said wick cutting means, and with said wick lighting means to activate said wick lighting means.

2. The candle maintenance device of claim 1, wherein said trigger means is manually operable to reciprocate said wick cutting means and activate said wick lighting means.

3. The candle maintenance device of claim 1, further comprising a wick tool attached to said body for manipulating a candlewick.

4. The candle maintenance device of claim 1, wherein said wick cutting means is retractable relative to said body, by operation of said trigger means.

5. The candle maintenance device of claim 1, further comprising:

a fire shield supported on said body positioned to surround a portion of said wick lighting means.

6. The candle maintenance device of claim 1, further comprising:

a safety lock interconnected with said trigger means movable between a locked position preventing operation of said trigger means and a released position allowing operation thereof.

7. The candle maintenance device of claim 1, wherein said wick lighting means includes a fuel cell supported by said body, said fuel cell releasing a fuel upon activation by said trigger means.

8. The candle maintenance device of claim 7, wherein said fuel cell is a removable cartridge.

9. The candle maintenance device of claim 7, wherein said wick lighting means includes an igniter source supported by said body and operatively connected with said trigger means to ignite the fuel released by said fuel cell, by operation of said trigger means.

10. The candle maintenance device of claim 9, wherein said igniter source is a piezoelectric device that creates a spark to ignite the released fuel.

11. A candle maintenance device comprising:

a body having a handle portion and a tube portion extending therefrom;

manually operable trigger means movably connected to said handle portion;

wick cutting means movably supported on said body for cutting a candlewick upon reciprocal movement relative to said body and connected with said trigger means to be moved thereby; and wick lighting means supported on said body for igniting the candlewick upon activation thereof and operatively connected with said trigger means to be activated thereby; wherein said wick cutting means is reciprocated to cut a candlewick and said wick lighting means is activated to ignite the candlewick, by operation of said trigger means.

12. The candle maintenance device of claim 11, wherein said wick cutting means is retractable relative to said body, by operation of said trigger means.

13. The candle maintenance device of claim 11, wherein said wick cutting means is connected with said trigger means by a cutting actuator mechanism, and comprises a cutting guide for receiving the candlewick and a cutting blade positioned relative thereto such that relative movement therebetween, by operation of said trigger means, cuts the candlewick.

14. The candle maintenance device of claim 11, further comprising a wick tool attached to said body for manipulating a candlewick.

15. The candle maintenance device of claim 11, further comprising a safety lock interconnected with said trigger means movable between a locked position preventing operation of said trigger means and a released position allowing operation thereof.

16. The candle maintenance device of claim 11, further comprising a fire shield contained within said tube portion positioned to surround a portion of said wick lighting means.

17. The candle maintenance device of claim 11, wherein said wick lighting means includes a fuel cell that releases a fuel by operation of said trigger means, and an igniter source operatively connected with said trigger means to ignite the fuel released by said fuel cell.

18. The candle maintenance device of claim 17, wherein said igniter source is a piezoelectric device that creates a spark to ignite the released fuel.

19. A candle maintenance device comprising:

a body having a handle portion and a tube portion extending therefrom;

a manually operable trigger member movably connected to said handle portion;

a wick cutting member movably supported on said body connected by a cutting actuator mechanism to said trigger member for reciprocal movement relative to said body; and wick lighting means supported on said body including an igniter source connected with said trigger member to be activated thereby and a fuel cell containing a fuel, said fuel cell supported by said handle portion and connected with said trigger member; wherein a candlewick is inserted into said wick cutting means, and by operation of said trigger member, said wick cutting means is reciprocated to cut the candlewick, fuel is released from said fuel cell, and said igniter source is activated to ignite released fuel, and the ignited fuel ignites the candlewick.

20. The candle maintenance device of claim 19, further comprising a safety lock interconnected with said trigger member movable between a locked position preventing operation of said trigger member and a released position allowing operation thereof.

21. The candle maintenance device of claim 19, further comprising a wick tool hingedly attached to said handle portion for manipulating a candlewick.

* * * * *